US005516254A

United States Patent [19]

Gessler

[11] Patent Number: 5,516,254

[45] Date of Patent: May 14, 1996

[54] SUPPLEMENTARY UNIT FOR FORK LIFT TRUCKS

[75] Inventor: Hermann Gessler, Friedrichshafen, Germany

[73] Assignee: Wirth Maschinenbau, Meckenbeuren, Germany

[21] Appl. No.: 256,701

[22] PCT Filed: Jan. 21, 1993

[86] PCT No.: PCT/EP93/00135

§ 371 Date: Sep. 14, 1994

§ 102(e) Date: Sep. 14, 1994

[87] PCT Pub. No.: WO93/14018

PCT Pub. Date: Jul. 22, 1993

[30] Foreign Application Priority Data

Jan. 21, 1992 [DE] Germany ..... 9200663 U
Mar. 6, 1992 [DE] Germany ..... 9202997 U

[51] Int. Cl.[6] ..... B66F 9/18

[52] U.S. Cl. ..... 414/607; 414/11; 414/783; 414/737; 414/627; 414/744.2

[58] Field of Search ..... 414/607, 608, 414/758, 10, 11, 639, 641, 663, 732, 735, 737, 627, 738, 754, 783, 744.2, 744.3, 744.7, 744.8, 640; 901/22; 254/3 R

[56] References Cited

U.S. PATENT DOCUMENTS

| | | | |
|---|---|---|---|
| 3,598,263 | 8/1971 | Ehmke . | |
| 3,773,200 | 11/1973 | Morris . | |
| 4,050,574 | 9/1977 | Chenevard et al. | 414/737 X |
| 4,604,026 | 8/1986 | Barrett | 414/737 X |
| 4,676,713 | 6/1987 | Voelpel . | |
| 4,912,994 | 4/1990 | Roberts . | |
| 5,190,333 | 3/1993 | Minichan et al. | 414/783 X |

FOREIGN PATENT DOCUMENTS

| | | | |
|---|---|---|---|
| 1316425 | 1/1963 | France . | |
| 2514738 | 4/1983 | France . | |
| 1208247 | 12/1965 | Germany . | |
| 3047593 | 11/1981 | Germany | 414/11 |
| 3834311 | 4/1990 | Germany . | |
| 132100 | 5/1990 | Japan | 414/11 |
| 176243 | 7/1991 | Japan | 414/11 |
| 1333567 | 8/1987 | U.S.S.R. | 414/11 |

*Primary Examiner*—Frank E. Werner
*Attorney, Agent, or Firm*—Michael J. Folise

[57] ABSTRACT

The present invention refers to a supplementary unit for a travelling fork lift truck used for picking up platelike mounting elements. The platelike mounting elements are picked up by a pick-up means of the supplementary unit, said pick-up means being secured to a frame via a carrier arm and a guide rod. The frame is adapted to be lifted by the forks of the fork lift truck. When the carrier arm is pivoted through an angle of 90°, the pick-up means, which is guided by the guide rod, will be turned through an angle of 180°. The pivoting movement of the carrier arm is carried out by a hydraulic lifting cylinder.

12 Claims, 3 Drawing Sheets

SUPPLEMENTARY UNIT FOR FORK LIFT TRUCKS

DESCRIPTION

Figure 1:
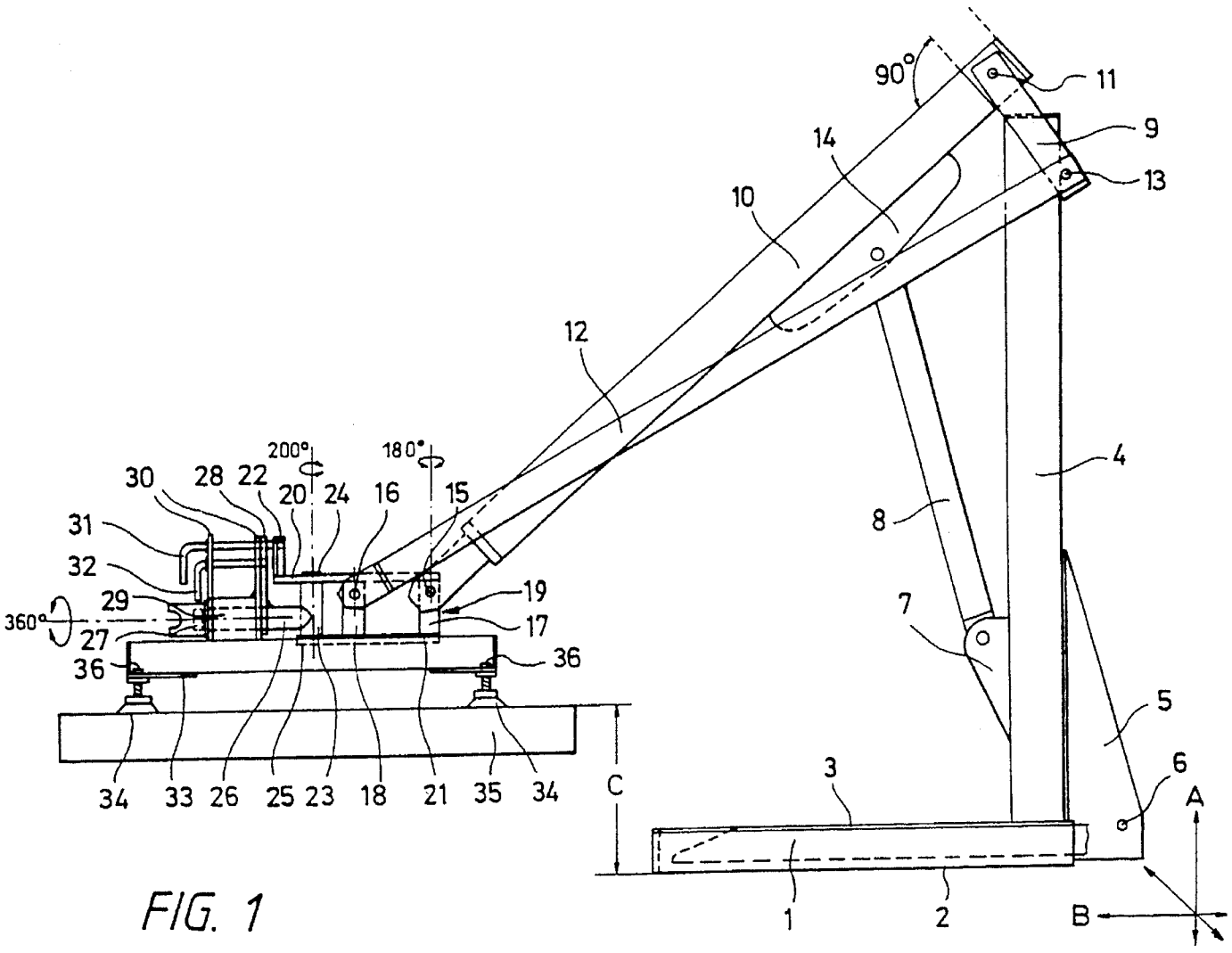

The present invention refers to a supplementary unit for a travelling fork lift truck, comprising a frame which is adapted to be connected to the forks of the fork lift truck, and a pick-up means provided with gripping elements for holding platelike mounting elements, said pick-up means being arranged on a carrier arm which is supported on said frame such that it is pivotable about a horizontal shaft so as to pick up the platelike mounting elements from a pick-up position and so as to set them down in a mounting position.

This type of device is known from U.S. Pat. No. 3,598,263. This publication shows a supplementary unit used for a fork lift truck and provided with a pick-up means having a carrier arm which is arranged thereon at an angle of 45°. The frame of the supplementary unit has articulated thereon two hydraulic lifting cylinders which are arranged one on top of the other and which are secured to the carrier arm at a predetermined distance from one another. By activating the hydraulic cylinders at different times and/or to different degrees, it is possible to pivot the pick-up means to a limited extent. This device cannot be used for picking up mounting elements, especially thermo-isolation sandwich panels, from a horizontal pick-up position. Moreover, it is comparatively difficult to control the pivoting movement of said device. This disadvantage will have unfavourable consequences primarily with respect to the handling of comparatively large thermo-isolation sandwich panels which are used in refrigerating chambers and cold storage houses. The thermo-isolation sandwich panels have a high weight of up to 800 kg and a large area of up to 40 $m^2$, and, consequently, the plates are difficult to handle and the use of a lifting device is absolutely necessary.

Furthermore, the prior art discloses supplementary units having an extension arm at the end of which a pick-up means is arranged, which is adapted to be pivoted by a rotary drive means. In this respect, reference is made to the literature source, German periodical "Fördern und Heben", No. 6, June 1961, page 361. However, such known supplementary units do not permit mounting elements to be set down in an overhead mounting position. In addition, the rotary drive means used in this type of supplementary units normally entail considerable costs.

It is the object of the present invention to improve a supplementary unit in such a way that a simple actuator can be used for handling the platelike mounting elements.

In accordance with the present invention, this object is achieved by the features that the pick-up means is provided with two spaced bearing locations with pivot bearings permitting vertical pivoting, the first bearing location being articulated on the carrier arm which is adapted to be pivoted on the frame about a first horizontal shaft and the second bearing location being connected to a guide rod which is articulated on the frame such that it is adapted to be pivoted about a second horizontal shaft extending in spaced relationship with said first horizontal shaft, and that an actuator used for pivoting the carrier arm about the first horizontal shaft is arranged between the carrier arm and the frame, the two bearing locations and the two horizontal shafts being arranged relative to one another in such a way that, when the pick-up means is turned round by 180° from the pick-up position into an overhead mounting position, the carrier arm can be pivoted about the first horizontal shaft on the frame by an angle of less than 180°, preferably 90°.

The supplementary unit according to the present invention permits a reduction of the pivoting power due to the fact that the pick-up means is lifted not only by the carrier arm arranged on the frame, but is, in addition, also guided by a guide rod which is articulated on the frame as well. It is important that there is a separation between the two horizontal shafts on the frame as well as the two bearing locations on the pick-up means. Depending on the articulation points of the carrier arm and of the guide rod, it is thus possible to predetermine various sequences of motions for the pick-up means during the carrier arm pivoting process. The necessity of pivoting the carrier arm through an angle of 180° for moving also the platelike mounting elements into a mounting position turned by 180° can thus be avoided. The lifting work which has to be performed will thus be reduced as well, since the carrier arm with the pick-up means has to travel only part of the vertical distance. The actuator is provided between the carrier arm and the frame. A simple lifting cylinder, for example, will thus suffice to carry out the pivoting movement of the carrier arm. The lifting cylinder is arranged on the carrier arm with an advantageous leverage so that the force which has to be applied by the lifting cylinder will be reduced. The carrier arm can be locked in any position by the actuator during the pivoting process. It follows that also intermediate positions for the platelike mounting elements can be adjusted and locked by the actuator, said intermediate positions comprising angles of from 0° to 180°. Mounting of the platelike mounting elements is thus possible in a variety of positions comprising positions on the floor, positions on the wall with various degrees of inclination as well as positions on the ceiling. The arrangement of the two bearing locations and of the two horizontal shafts relative to one another is preferably chosen such that the pivoting angle of the carrier arm, which causes the platelike mounting elements to be turned through an angle of 180°, is set to an angle of 90°. The lifting work which the actuator of the supplementary unit has to perform is reduced to a considerable extent. The actuator can be constructed such that it has less power and smaller dimensions. This embodiment has the additional advantage that the two horizontal shafts and the two bearing locations are each located at a comparatively short distance from one another, whereby a compact structural design is obtained because the difference in length between the carrier arm and the guide rod is only comparatively small.

In accordance with a preferred embodiment, the two bearing locations may be arranged on a rotatable pick-up device having arranged thereon the pick-up means such that it is adapted to be pivoted on a vertical shaft. The platelike mounting elements can then be pivoted about an additional shaft during the mounting process, and this will permit better handling as well as the arrangement of the mounting elements in an inclined position.

In an additional embodiment of the supplementary unit, the two bearing locations are arranged on a rotatable pick-up device having arranged theron a vertical shaft with a horizontal rotational shaft. The pick-up means is then arranged such that it is adapted to be pivoted about the vertical shaft, said vertical shaft being simultaneously adapted to be rotated about the horizontal rotational shaft. This will result in improved handling of the mounting elements during the mounting operation, and alignment errors of the fork lift truck relative to the mounting plane will be compensated for.

In an advantageous further embodiment, the gripping elements are constructed as suckers, a plurality of said suckers being arranged on the pick-up means. This simple embodiment of the gripping elements is particularly suitable for plates having smooth surfaces. The suckers are provided with air discharge means for increasing the suction effect when the mounting elements are picked up and for achieving a rapid release of the suckers when the mounting elements are set down. The connection of said air discharge means is arranged in an advantageous manner at the free end of the horizontal rotational shaft, whereby said connection will rotate together with the rotational shaft and whereby damage to the air conduit due to twisting will be avoided.

Furthermore, the horizontal rotational shaft and the vertical shaft are constructed as tubular sections, the cavities being interconnected by a hole provided in the circumferential surface of the vertical shaft. This has the advantage that the horizontal rotational shaft and the vertical shaft can be used as air conduits which communicate with the connection at the end of the horizontal rotational shaft. This permits the air to be guided along a path leading from the rotatable pick-up device to the air discharge means, and, along this path, two movable shafts are bridged without any hose impeding these movements.

It will be advantageous when both ends of the vertical shaft are provided with air connection means. The supply or the discharge of air can then be effected selectively from one of the two ends or from both ends. These connection points only carry out a pivoting movement, and, consequently, they permit the use of a simple hose supply line to the connections.

It will also be advantageous when the air connection means are constructed as axially supported connection adapters arranged in the hole of a respective tubular section of the vertical shaft and/or of the horizontal rotational shaft. The connection adapters are rotatably supported in the respective hole of the tubular profiles and they are adapted to be connected to air hoses or conduits. This embodiment is a simple structural solution by means of which the air hoses can be connected such that they are secured against twisting.

It will be particularly helpful when the the pick-up means has attached thereto a deflection lever, which, when actuated, will block the movements about the horizontal rotational shaft. This limitation of movements is particularly important with respect to positioning as well as safe working during mounting of the platelike mounting elments. On the one hand, the platelike mounting elements are thus prevented from turning too far upon being released. On the other hand, angular corrections can still be carried out during the mounting operation by pivoting about the vertical shaft.

It will be advantageous when the pick-up means is provided with a pivoting-motion blocking means, which, when actuated, will prevent all types of movements about the horizontal rotational shaft and the vertical shaft. The platelike mounting elements can then only carry out the pivoting movement about the first bearing location on the reception means, whereas in all other directions of movement they are arrested. This will reduce the danger of accidents.

In one type of embodiment, the frame may have a vertical support having secured thereto the first and second horizontal shafts. A horizontal support, which is adapted to be connected to the forks of the fork lift truck and which is connected to the vertical support and projects on the same side as the carrier arm, has the advantage that the supplementary unit will have small dimensions and the centre of gravity of the supplementary unit will press on the forks of the fork lift truck. Tilting of the supplementary unit in the no-load condition will not take place.

In accordance with a further embodiment, one or a plurality of reinforcement ribs is arranged on the vertical support of the frame on the side facing the fork lift truck, each of said reinforcement ribs being provided with a hole. The hole is provided for receiving therein fastening elements and it is dimensioned such that fastening to the lifting unit of various types of fork lift trucks is possible. This positive engagement with the fork lift truck guarantees that the supplementary unit is safely held when used for mounting operations.

In order to facilitate work, a drive means, e.g. an electric motor or a hydraulic drive, for effecting the pivoting movement about the vertical shaft and the horizontal rotational shaft can additionally be provided. In the case of this embodiment, all mounting movements can be controlled from the cockpit of the fork lift truck.

Figure 2:
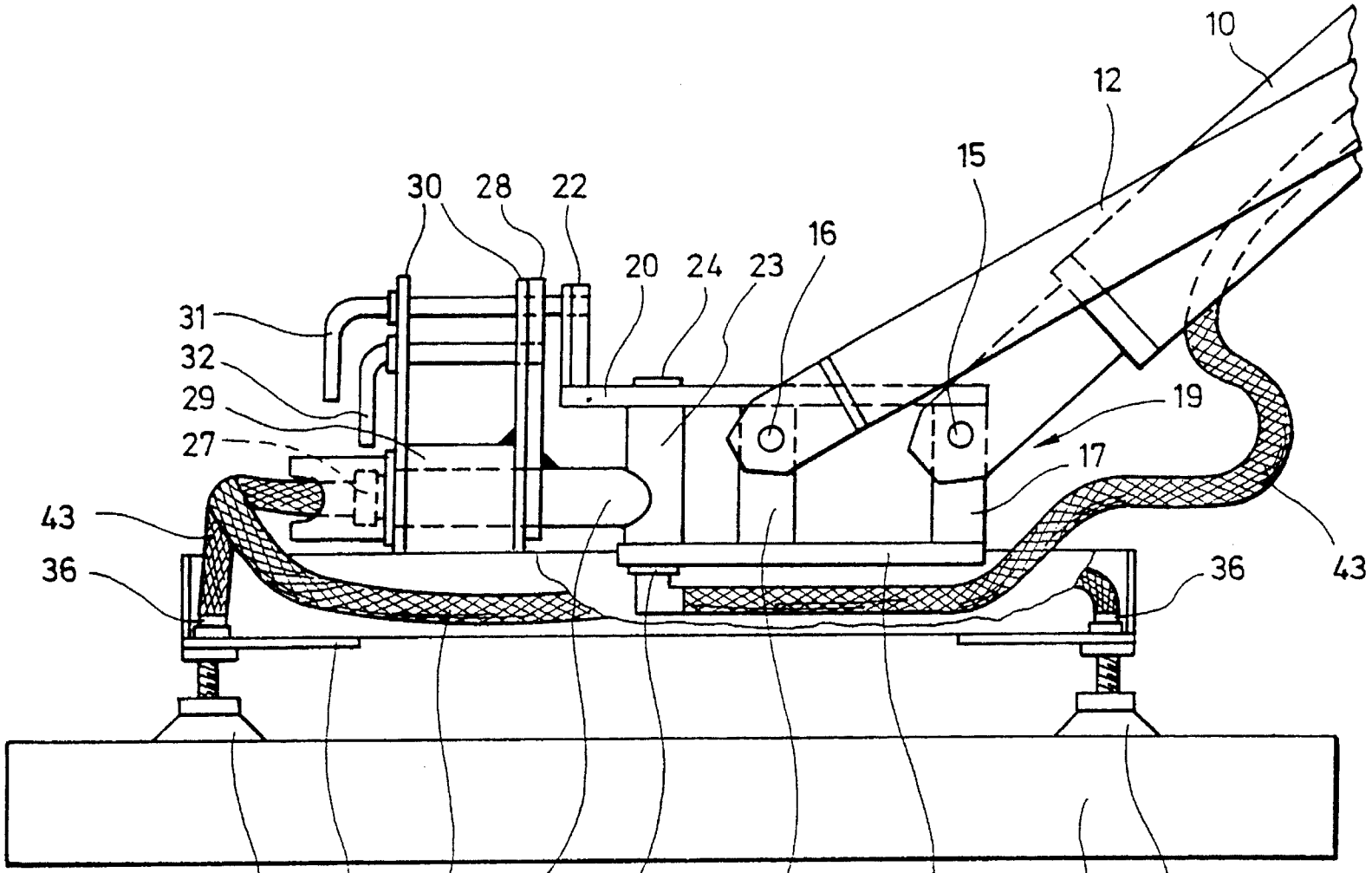
Figure 3:
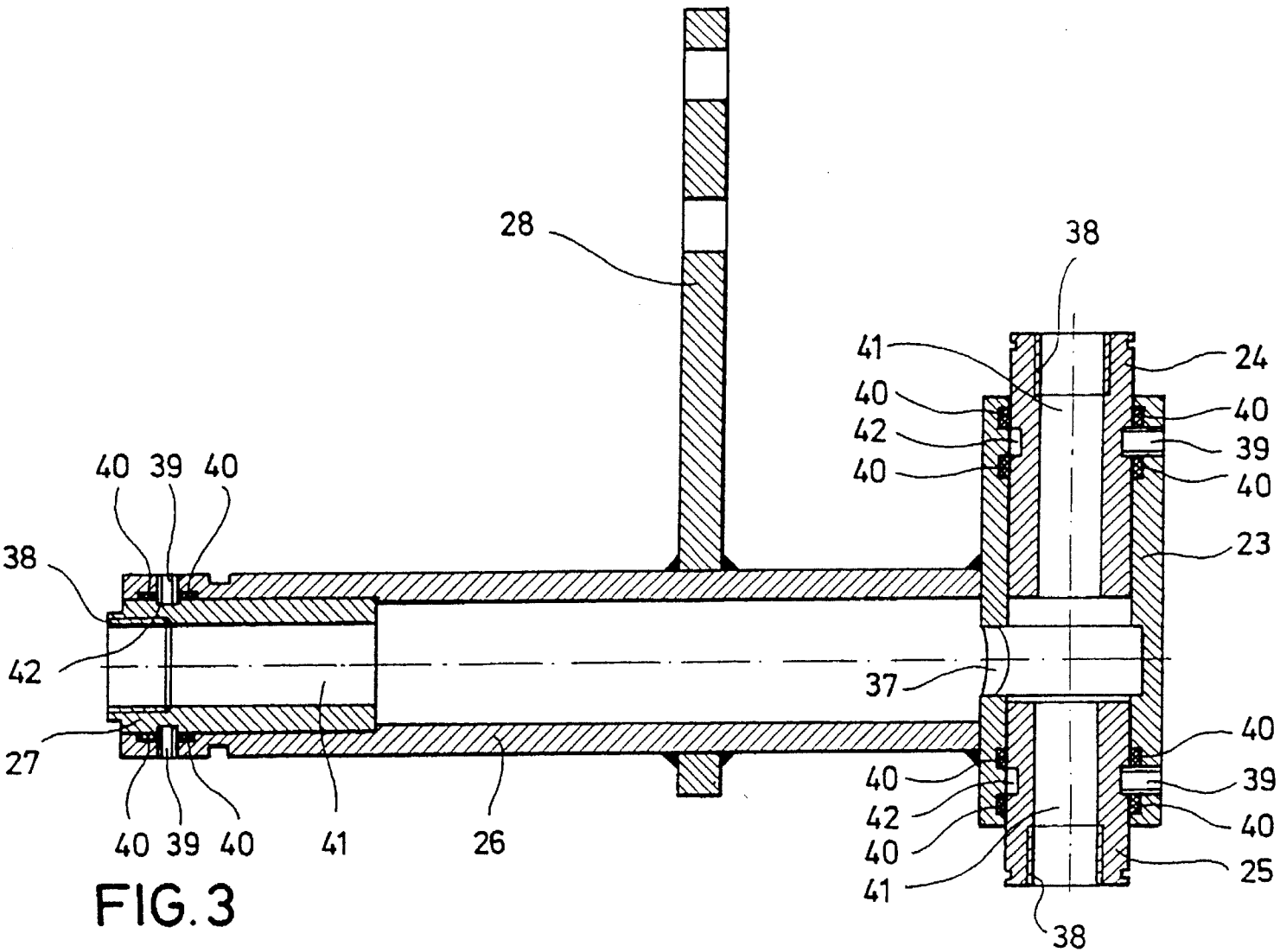

In the following, one embodiment of the supplementary unit according to the present invention will be explained in detail on the basis of a drawing, in which:

FIG. 1 shows a side view of a supplementary unit according to the present invention with a platelike mounting element (to simplify matters no air hoses are shown in FIG. 1), FIG. 2 shows an enlarged representation of the pick-up means of the supplementary unit of FIG. 1, the air hoses being this time shown, and FIG. 3 shows an enlarged representation of the vertical shaft and of the horizontal rotational shaft of the supplementary unit of FIG. 1.

As can be seen in FIG. 1, the supplementary unit according to the present invention is adapted to be connected to the forks 1 of a fork lift truck, which is not shown. The forks 1 are introduced into two adequately dimensioned sections 2 with a square profile, which are oriented parallel to each other. By means of the fork lift truck, the supplementary unit can be displaced in a direction resulting from direction A and direction B or in the opposite direction thereof. Making use of a known connection method, such as welding or brazing, the sections 2 with a square profile are fixedly connected to the lower side of the frame. The frame comprises a base plate in the form of a horizontal support 3 as well as a vertical support 4 which is secured to said horizontal support 3 such that it extends essentially at right angles thereto. The vertical support 4 is secured to the horizontal support 3 preferably by means of welding. On the side of the vertical support 4 facing away from the horizontal support 3, at least one reinforcement rib 5 is arranged, said reinforcement rib 5 having a hole 6 so that it can be fastened to the fork lift truck with the aid of a known fixing means, e.g. a bolt plus cotter pin. A rib 7 is provided 5 on the vertical support 4 opposite the reinforcement rib 5, said rib 7 having arranged thereon an actuator 8, preferably a hydraulic lifting cylinder, which is known per se. The vertical support 4 is connected, preferably by means of welding, to an obliquely positioned crossmember 9 at its end located opposite the horizontal support 3. A carrier arm 10 is articulated on one end of the crossmember 9 with the aid of a first horizontal shaft 11, and a guide rod 12 is supported at the second end of said crossmember 9 by means of a second horizontal shaft 13. The carrier arm 10 has provided thereon a longitudinal rib 14 for receiving the hydraulic lifting cylinder. The hydraulic lifting cylinder is supported between the rib 7 on the frame and the longitudinal rib 14 on the carrier arm 10. On the side on which the carrier arm 10 and the guide rod 12 face away from the frame, said carrier arm 10 is movably connected to a first bearing location 15 and said guide rod 12 is movably connected to a second bearing location 16. The two bearing locations 15 and 16 are each supported on a separator 17 and 18, respectively, of a rotatable pick-up device 19.

FIG. 2 shows in a particularly clear manner that the rotatable pick-up device 19 is composed of an upper cover plate 20 and of a lower cover plate 21, which are spaced apart by the two separators 17 and 18. Furthermore, a locking element 22 is arranged at one end of the upper cover plate 20, said locking element 22 extending at right angles to said cover plate 20. A vertical shaft 23, which is rotatably supported, is located between said upper and lower cover plates 20 and 21.

As can especially be seen from FIG. 3, the vertical shaft 23 is constructed as a tubular section, and air connection means 24 and 25 are arranged at the respective ends of said vertical shaft 23. The air connection means 24 and 25 are constructed as connection adapters, which each have a continuous axial hole 41 and which are inserted in the hole of the vertical shaft 23 with a certain amount of play. The circumferential surface of the connection adapters has provided therein an annular groove 42, which is engaged by a set screw 39 radially screwed into the shaft wall. As can be seen e.g. in FIG. 2, the ends of the air connection means 24 and 25, which project beyond the vertical shaft 23, are adequately guided in holes provided in the lower and upper cover plates 20 and 21. Furthermore, the inner wall of the vertical shaft 23 is provided with annular sealing means 40 inserted in grooves and permitting the vertical shaft 23 to move, said annular sealing means 40 resting on the air connection means 24 and 25 above and below the annular groove 42. The vertical shaft 23 is supported such that it is selectively freely rotatable around the air connection means 24 and 25. The ends of said air connection means 24 and 25 projecting beyond the vertical shaft 23 are provided with internal screw threads 38 for attaching thereto an air hose 43. In FIG. 2, the air connection means 25 has attached thereto an air hose 43, whereas the air connection means 24 is closed by a plug which is not shown.

A horizontal rotational shaft 26 is arranged on the vertical shaft 23 such that it extends at right angles thereto, the connection end of said rotational shaft 26 having an adequate shape and being connected to the vertical shaft 23 preferably by means of welding. Also the horizontal rotational shaft 26 consists of a tubular section. The cavities of the rotational shaft 26 and of the vertical shaft 23 are interconnected by a hole in the outer wall of the vertical shaft 23. At the free end of the horizontal rotational shaft 26, a connection 27 used for discharging air is provided. The structural design of said connection 27 resembles that of the air connection means 24 and 25 in the vertical shaft 23 and permits an air hose 43 to be screwed onto said connection 27 axially to the horizontal rotational shaft 26 such that it is secured against rotation relative to said connection 27. For this purpose, the connection 27 is rotatably supported in the hole of the horizontal rotational shaft 26, it is axially secured by means of the set screws 39 and it is sealed with respect to the horizontal rotational shaft 26 with the aid of the annular sealing means 40. A rotation blocking means 28, which is fixedly connected to the horizontal rotational shaft 26, projects approximately in the middle of said rotational shaft 26 on one side thereof. A rotary bearing 29, which is connected to a pickup means, is provided on the horizontal rotational shaft 26, which is arranged such that it is adapted to be rotated together with the vertical shaft 23. The pick-up means is adapted to be rotated about the horizontal rotational shaft 26 by means of said rotary bearing 29. Holding devices 30 are secured in position on both sides of the rotary bearing 29, said holding devices 30 being used for guiding a deflection lever 32 and a catch lever 31. The rotation blocking means 28 and the locking element 22 are provided with holes for receiving therein the deflection lever 32 and the catch lever 31. The catch lever 31 is longer than the deflection lever 32 and, in its locking position, it engages also the locking element 22 in addition to the rotation blocking means 28.

The pick-up means consists of a rectangular or almost I-shaped frame member 33 having arranged thereon a plurality of gripping elements 34, preferably suckers, which are provided with a connection 36 for an air conduit 43 and which serve to take hold of platelike mounting elements 35. The air conduits 43 of the suckers 34 are jointly connected to the connection 27 at the end of the horizontal rotational shaft 26. The discharge of air is then continued through the horizontal rotational shaft 26 into the vertical shaft 23 and from said vertical shaft 23 the air is discharged by means of an air hose 43, which is arranged below the rotatable pick-up device 19 and which extends within the carrier arm 10 (FIG. 2) up to an air discharge station, which is not shown.

In the following, the mode of operation of a supplementary unit according to the present invention will be explained in detail.

First of all, the forks 1 of the fork lift truck are inserted into the sections 2 with a square profile of the frame for interconnecting the supplementary unit and the fork lift truck. The supplementary unit is additionally secured in position on the fork lift truck by means of the hole 6 in the reinforcement rib 5 and a connection element, preferably a bolt plus cotter pin. The supplementary unit can now be lifted and moved by the fork lift truck. If a mounting element 35 lying flat on the surface below is to be lifted, the supplementary unit will be moved by the fork lift truck to an adequate pick-up level.

FIG. 1 shows the supplementary unit in the pick-up position. When the forks 1 of the fork lift truck, which is not shown, simultaneously occupy their lowermost position, a minimum lower pick-up height C with respect to the lower edges of the sections 2 with a square profile will be obtained, said pick-up height C being used for picking up the platelike mounting elements 35. As can be seen in said FIG. 1, the lower pick-up height essentially depends on the length of the vertical support 4 and/or the lengths of the carrier arm 10 and the guide rod 12. This permits a desired optimization of said lower pick-up height C.

The gripping elements 34, preferably suckers, will then rest on the platelike mounting elements 35. By pressing the sukkers onto the surface of said mounting elements 35, a partial vacuum will be generated, which is additionally intensified by air connection means 36 provided on said suckers and connected to an air discharge station, which is not shown. By means of air hoses 43, the air is guided from the connections 36 on said suckers to the rotatable connection 27 on the horizontal rotational shaft 26, whereupon it is advanced through the tubular horizontal rotational shaft 26 into the vertical shaft 23, which has a tubular shape as well, and from said vertical shaft 23 it is guided via an air connection means 25 into an air hose 43, which preferably extends within the carrier arm 10 and which leads to an air supply station. The air supply station does not only intensify the partial vacuum, which causes the mounting elements 35 to be picked up reliably, but, when the mounting elements 35 have been mounted, it may also cause a rapid disengagement of the suckers by means of overpressure. The fact that the air is guided through the vertical shaft 23 and the horizontal rotational shaft 26 has the advantage that no air guiding element (e.g. hose) will be destroyed by the movements of the pick-up means. With the aid of the special structural design of the air connection means 24, 25 and 27, a mode of guiding the air is achieved, which is flexible on the one hand and which, due to the provision of the annular sealing means, prevents leakage of air on the other.

When the mounting elements 35 have been picked up, the actuator 8, preferably a hydraulic lifting cylinder, is activated. The activation can preferably be effected from the cockpit of the fork lift truck. The lifting rod of the hydraulic lifting cylinder will be extended, whereby the carrier arm 10 will be moved upwards while rotating about the first horizontal shaft 11. The first bearing location 15 on the rotatable pick-up device 19 will move along a circular path around the first horizontal shaft 11. Simultaneously, the second bearing location 16, which is guided by the guide rod 12, will move along a circular path around the second horizontal shaft 13. The centres of the two circular paths are displaced relative to each other in such a way that the movement of the first bearing location 15 will begin with a smaller gradient of the tangent on the circular path than that of the second bearing location 16. In addition, the centres of the circular paths are located such that said circular paths will intersect, i.e. a descent of the gradient of the tangent will first take place on the circular path of the second bearing location 16 during the pivotal movement of the carrier arm 10. This predetermined movement will automatically subject the second bearing location 16 to a traction force, which, in a continued movement, will move the second bearing location 16 on a circular path around the first bearing location 15, whereby the whole pick-up means plus the mounting element 35 will be tilted in a rotational movement. The arrrangement of the two horizontal shafts 11 and 13 and of the two bearing locations 15 and 16 relative to each other is chosen such that, during pivoting of the carrier arm 10 through an angle of 90° an 180° rotational movement of the second bearing location 16 around the first bearing location 15 will be carried out. Hence, the platelike mounting element 35 is turned round completely. Due to the continuous control of the hydraulic lifting cylinder, all intermediate positions in an angular range of from 0° to 180° of the mounting elements 35 can be adjusted. The platelike mounting elements 35 can now be mounted on walls as well as on ceilings.

Inaccuracies of angles of the mounting base or of the position of the fork lift truck can be compensated for by the vertical shaft 23 and by the horizontal rotational shaft 26. The vertical shaft 23 preferably has a pivoting angle of 200°, and the horizontal rotational shaft 26 is adapted to be rotated with a pivoting angle of 360° depending on the position of the carrier arm 10 and the guide rod 12. The movements around the horizontal rotational shaft 26 and the vertical shaft 23 can also be carried out by a drive means which is adapted to be controlled from the cockpit of the fork lift truck, said drive means being not shown.

In order to prevent movements around the vertical shaft 23 and the horizontal rotational shaft 26 during the pivoting process of the carrier arm 10, a catch lever 31 is provided, which is adapted to be brought into locking engagement with holes of the rotation blocking means 28 and of the locking element 22 and which will then only permit the tilting movement of the pick-up means.

Furthermore, a deflection lever 32 is provided for mounting operations, said deflection lever 32 being adapted to be inserted only in the hole of the rotation blocking means 28, whereby pivoting about the vertical shaft 23 will be possible, whereas the rotational movement about the rotational shaft 26 will be blocked.

Due to the fact that a carrier arm pivoting angle of only 90° is sufficient for turning round the mounting elements 35 completely, the supplementary unit will only require a comparatively small lifting height of the carrier arm for the turning operation.

It is evident that one carrier arm 10 and one guide rod 12 may be provided on either side of the vertical support 4 so that the carrier arms 10 may have narrower dimensions. A symmetrical arrangement of the carrier arms 10 and of the guide rod 12 prevents the bearing locations 15 and 16 and the horizontal shafts 11 and 13 from having applied thereto additional moments. It is also possible to arrange one carrier arm 10 and one guide rod 12 symmetrically on the vertical support 4.

Although the supplementary unit was described on the basis of a mounting operation of thermo-isolation sandwich panels, it is just as well imaginable that the platelike mounting elements 35 may consist of other materials, such as concrete, gypsum wallboards, glass, wood etc. The mounting elements 35 may also be a composite panel consisting of different materials. In this case, the gripping elements 34 of the pick-up means are holding devices having an adequate structural design.

I claim:

1. A supplementary unit for a travelling fork lift truck having elevatable forks comprising:

a frame having elongated apertures adapted to be connected to the forks (1) of the fork lift truck;

a pick up means (33) provided with gripping elements (34) for holding plate-like mounting elements (35), said pick-p means being arranged on a carrier arm (10) which is supported on said frame such that it is pivotable about a first horizontal shaft (11) so as to pick up the plate-like mounting elements (35) from a pick-up position and so as to set them down in an overhead mounting position, wherein the pick-up means is provided with two spaced bearing locations (15 and 16) with pivot bearings permitting vertical pivoting, the first bearing location (15) being articulated on the carrier arm (10) which is adapted to be pivoted on the frame about the first horizontal shaft (11) and the second bearing location (16) being connected to a guide rod (12) which is articulated on the frame such that it is adapted to be pivoted about a second horizontal shaft (13) extending in spaced relationship with said first horizontal shaft (11); and, an actuator (8) for pivoting the carrier arm (10) about the first horizontal shaft (11) arranged between the carrier arm (10) and the frame, the two bearing locations (15 and 16) and the two horizontal shafts (11 and 13) being arranged relative to one another in such a way that, when the pick-up means (33) is turned round by 180° from the pick-up position into an overhead mounting position, the carrier arm (10) can be pivoted about the first horizontal shaft (11) on the frame through an angle of rotation of less than 180°, wherein the first and second bearing locations (15 and 16) are located on a rotatable pick-up device (19) connected to the pick-up means (33) by a vertical shaft (23) and a horizontal rotational shaft (26), said horizontal rotational shaft (26) being pivotably supported on said vertical shaft (23), and the pick-up means (33) being rotatably supported on the horizontal rotational shaft (26).

2. The supplementary unit of claim 1, wherein the gripping elements (34) are constructed as suckers, which are provided with an air discharge means for expelling air and having a connection (27) arranged at a free end of the horizontal rotational shaft (26).

3. The supplementary unit of claim 2, wherein the horizontal rotational shaft (26) and the vertical shaft (23) are constructed as tubular sections, the horizontal rotational shaft (26) being connected to a circumferential surface of the vertical shaft (23) and cavities of said tubular sections being interconnected by a hole provided in the circumferential surface of said vertical shaft (23).

4. The supplementary unit of claim 3, wherein two ends of the vertical shaft (23) are adapted to be provided with air connection means (24, 27).

5. The supplementary unit of claim 4, wherein the air connection means (24, 27) are constructed as axially supported connection adapters arranged in a hole of a respective tubular section of the vertical shaft (23) and of the horizontal rotational shaft (26), said connection adapters being rotatably supported in the respective hole of the tubular sections and being adapted to be connected to conduits (43).

6. The supplementary unit of claim 4, wherein the air connection means (24, 27) are constructed as axially supported connection adapters arranged in the hole of a respective tubular section of the vertical shaft (23) or of the horizontal rotational shaft (26), said connection adapters being rotatably supported in the respective hole of the tubular sections and being adapted to be connected to conduits (43).

7. The supplementary unit of claim 1, wherein the pick-up means is provided with a deflection lever (32) which is arranged in such a way that movement about the horizontal rotational shaft (26) can be blocked by actuating said deflection lever (32).

8. The supplementary unit of claim 1, wherein the pick-up means is provided with a catch lever (31), and that movements about the horizontal rotational shaft (26), and the vertical shaft (23) of said pick-up means can be blocked by actuating said catch lever (31).

9. The supplementary unit of claim 1 wherein the frame has a vertical support (4) which carries the first and second horizontal shafts (11 and 13), and a horizontal support (3) which is adapted to be connected to the forks (1) of the fork lift truck and which projects on a same side of the vertical support (4) as the carrier arm (10).

10. The supplementary unit of claim 9, wherein at least one reinforcement rib (5) is arranged on the vertical support (4) of the frame on the side facing away from the horizontal support (3), said reinforcement rib (5) being provided with a hole (6) by means of which the frame can be connected to the fork lift truck.

11. The supplementary unit of claim 1, wherein there is provided a drive means, for effecting the pivoting movement about the vertical shaft (23) and the horizontal rotational shaft (26).

12. The supplementary unit of claim 1, wherein there is provided a drive means, for effecting the pivoting movement about the vertical shaft (23) or the horizontal rotational shaft (26).

* * * * *

UNITED STATES PATENT AND TRADEMARK OFFICE

CERTIFICATE OF CORRECTION

PATENT NO. : 5,516,254

DATED : May 14, 1996

INVENTOR(S) : Hermann Gessler

It is certified that error appears in the above-indentified patent and that said Letters Patent is hereby corrected as shown below:

At column 8, line 31, delete the word "pick-p" and insert the word --pick-up--

Signed and Sealed this

Eighth Day of October, 1996

Bruce Lehman

*Attest:*

BRUCE LEHMAN

*Attesting Officer*

*Commissioner of Patents and Trademarks*